US006083455A

United States Patent [19]

Kurita et al.

[11] Patent Number: 6,083,455

[45] Date of Patent: Jul. 4, 2000

[54] STEELS, STEEL PRODUCTS FOR NITRIDING, NITRIDED STEEL PARTS

[75] Inventors: Masato Kurita, Takarazuka; Koji Watari, Nishinomiya; Toru Kato, Tonosho-machi; Harunori Kakimi, Sakai; Mitsuo Uno, Fukuoka; Masanori Sakamoto; Yoshihiko Kamada, both of Kitakyushu, all of Japan

[73] Assignee: Sumitomo Metal Industries, Ltd., Osaka, Japan

[21] Appl. No.: 09/002,881

[22] Filed: Jan. 5, 1998

[51] Int. Cl.[7] ..... C22C 38/02; C22C 38/04; C22C 38/14

[52] U.S. Cl. ..... 420/126; 420/128; 148/318; 148/320

[58] Field of Search ..... 148/318, 320; 420/126, 128

[56] References Cited

U.S. PATENT DOCUMENTS 4,838,963 6/1989 Huchtemann et al. ..... 420/126

FOREIGN PATENT DOCUMENTS 58-71357 4/1983 Japan .
16948 1/1984 Japan ..... 148/318
63-137147 6/1988 Japan .
64-68424 3/1989 Japan .
1-177338 7/1989 Japan .
4-193931 7/1992 Japan .
8-144018 6/1996 Japan .
8-170146 7/1996 Japan .

*Primary Examiner*—Deborah Yee
*Attorney, Agent, or Firm*—Armstrong, Westerman, Hattori, McLeland & Naughton

[57] ABSTRACT

The present invention relates to manufacturing methods of nitrided steel parts, having high tensile strength, high fatigue strength, and excellent bending roughness, through nitriding without thermal refining, to thus-manufactured steel parts, and to steel products for nitriding, and steels for nitriding having a specific chemical composition, serving as steel stock for the manufacture of such steel parts. The chemical composition is as follows: C: over 0.20 to 0.60%, Si: 0.05 to 1.0%, Mn: 0.20 to 1.50%, P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.003 to 0.03%, Al: 0.08% or less, Ca: 0.005% or less, Pb: 0.30% or less, N: 0.008 to 0.030%, and the balance of Fe and unavoidable impurities. Steel products preferably have the ferrite-pearlite microstructure having a ferrite percentage of not less than 10%. Nitrided steel parts are formed from the steel products serving as steel stock therefor, and have a nitrided case formed in the surface portion thereof.

13 Claims, 1 Drawing Sheet

STEELS, STEEL PRODUCTS FOR NITRIDING, NITRIDED STEEL PARTS

BACKGROUND OF THE INVENTION

The present invention relates to steels for nitriding, steel products for nitriding, nitrided steel parts, and manufacturing methods of nitrided steel parts. In particular, the present invention relates to manufacturing methods of nitrided steel parts, having high tensile strength, high fatigue strength, and excellent bending toughness, such as nitrided crankshafts for automobiles, industrial machinery, and construction machinery, through nitriding without thermal refining, to thus-manufactured steel parts, and to steel products for nitriding, and steels for nitriding having a specific chemical composition, serving as steel stock for the manufacture of such steel parts.

In manufacture of steel parts for automobiles, industrial machinery, and construction machinery, billets of carbon steels and alloy steels for machine structural use are formed into desired shapes through hot working such as hot forging, followed by (a) thermal refining to obtain a desired strength (herein, "thermal refining" refers to "quenching and tempering," "normalizing," or "normalizing and tempering") and, as needed, (b) surface hardening to impart a desired surface hardness to the thermally refined steel parts. Surface hardening (b) is intended to improve the fatigue strength, seizure resistance, and galling resistance of those parts that have undergone thermal refining (a). Regardless of whether or not surface hardening (b) is performed after thermal refining (a), thermally refined steel parts may be machined so as to assume their final shapes. When surface hardening (b) is performed after thermal refining (a), surface-hardened steel parts may be polished or ground, so as to assume their final shapes.

Specific examples of surface hardening include carburizing and quenching, induction hardening, flame hardening, and nitriding (including soft-nitriding). In carburizing and quenching, induction hardening, or flame hardening, a steel part is quenched from a high-temperature zone of austenite to thereby be surface-hardened. The thus-quenched steel part suffers the occurrence of quenching distortion and may suffer the formation of a quenching crack.

Thus, for surface hardening of a steel part, whose distortion must be particularly small, nitriding is employed.

As an example of steel for nitriding, SACM645 (aluminum-chromium-molybdenum steel), which specified in JIS G 4202, is well known. However, due to addition of a large amount of Al and Cr, which improve the effect of nitriding, SACM645 involves a problem that melting, casting and hot working are relatively difficult to perform.

Steel parts for automobiles, industrial machinery, and construction machinery must have small distortion. To this end, these parts tend to undergo thermal refining and then nitriding. However, in recent years, so-called "eliminating thermal refining" has been studied in order to reduce cost through elimination of thermal refining which was formerly performed before nitriding. (Hereinafter, nitriding which is not preceded by thermal refining is referred to as "nitriding without thermal refining".)

However, when ordinary carbon steels and alloy steels for machine structural use, such as SCM435 and SACM645, as defined by JIS, are nitrided without first being subjected to thermal refining, a coarse microstructure that forms during hot working, such as hot forging, remains in the final products, i.e. machinery steel parts. Accordingly, steel parts that have undergone nitriding without thermal refining involve a reduction in fatigue strength and bending toughness.

Japanese Patent Application Laid-Open (kokai) No. 8-170146 discloses a technique for nitriding without thermal refining.

However, the lower limit of fatigue strength (fatigue limit), which the disclosed technique aims to achieve, is 38 kgf/mm$^2$ (373 MPa). Accordingly, this technique is not satisfactory when steel parts must have a higher fatigue strength.

SUMMARY OF THE INVENTION

An object of the present invention is to provide manufacturing methods of nitrided steel parts, having high fatigue strength and excellent bending toughness through nitriding without thermal refining, thus-manufactured steel parts, and steels for nitriding serving as core steels for nitriding. Nitrided steel parts of the present invention have a fatigue strength (fatigue limit) of at least 382 MPa (39 kgf/mm$^2$), as measured by the Ono-type rotating bending fatigue test, and a bending toughness of not longer than 0.10 mm in crack length, as measured at the straightening operation with 1.5% tensile strain (herein, "bending toughness" refers to resistance to generation of cracks in straightening operation). Examples of such nitrided steel parts include nitrided crankshafts for automobiles, industrial machinery, and construction machinery.

Another object of the present invention is to provide manufacturing methods of nitrided steel parts, in particular, nitrided crankshafts for automobiles, industrial machinery, and construction machinery, having a tensile strength of at least 500 MPa, a fatigue strength of at least 382 MPa, as measured by the Ono-type rotating bending fatigue test, and a bending toughness of at least 6 mm in critical cracking stroke, as measured by the 3-points bending test performed on a test piece shown in FIG. 1 (described later); thus-manufactured steel parts, and steel products for nitriding serving as steel stock for the manufacture of such steel parts.

The gist of the present invention will be summarized below.

(1) A steel for nitriding having a chemical composition based on % by weight: C: over 0.20 to 0.60%, Si: 0.05 to 1.0%, Mn: 0.20 to 1.50%, P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.03% or less, Al: 0.08% or less, Ca: 0.005% or less, Pb: 0.30% or less, N: 0.008 to 0.030%, and the balance of Fe and unavoidable impurities.

(2) A steel for nitriding having a chemical composition based on % by weight: C: 0.30 to 0.40%, Si: 0.05 to 0.40%, Mn: 0.20 to 0.60%, P: 0.08% or less, S: 0.02 to 0.10%, Cr: 0.10% or less, Ti: 0.005 to 0.013%, Al: 0.005% or less, Ca: 0.0003 to 0.0030%, Pb: 0.20% or less, N: 0.010 to 0.030%, and the balance of Fe and unavoidable impurities.

(3) A steel product for nitriding having a chemical composition based on % by weight: C: over 0.20 to 0.60%, Si: 0.05 to 1.0%, Mn: 0.30 to 1.50%, P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.03% or less, Al: 0.08% or less, Ca: 0.005% or less, Pb: 0.30% or less, N: 0.008 to 0.020%; value of fn1 expressed by Equation (1) below: not less than 150, and the balance of Fe and unavoidable impurities, which has a ferrite-pearlite microstructure with a ferrite percentage of not less than 10%.

$$fn1=221C(\%)+99.5Mn(\%)+52.5Cr(\%)-304Ti(\%)+577N(\%)+25 \quad (1).$$

(4) A steel product for nitriding having a chemical composition based on % by weight: C: over 0.20 to 0.60%, Si:

0.05 to 1.0%, Mn: 0.30 to 1.50%, P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.03% or less, Al: 0.08% or less, Ca: 0.005% or less, Pb: 0.30% or less, N: 0.008 to 0.020%; value of fn1 expressed by Equation (1) below: not less than 150, value of fn2 expressed by Equation (2) below: not less than 15, and the balance of Fe and unavoidable impurities, which has a ferrite-pearlite microstructure with a ferrite percentage of not less than 10%.

$$fn1=221C(\%)+99.5Mn(\%)+52.5Cr(\%)-304Ti(\%)+577N(\%)+25 \quad (1),$$

$$fn2=-192C(\%)-32.8Mn(\%)-25.1Cr(\%)+467Ti(\%)+726N(\%)+112 \quad (2).$$

(5) A nitrided steel part, having the chemical composition of the steel described above in (1), and a nitrided case.

(6) A nitrided steel part, having the chemical composition of the steel described above in (2), and a nitrided case.

(7) A nitrided steel part, having the chemical Composition and microstructure described above in (3), and a nitrided case.

(8) A nitrided steel part, having the chemical composition and microstructure described above in (4), and a nitrided case.

(9) A manufacturing method of a nitrided steel part, comprising the steps of hot forging a steel product having the chemical composition described above in (1), and nitriding the steel product without thermal refining, so as to nitride the surface portion of the steel product thereby forming a nitrided case.

(10) A manufacturing method of a nitrided steel part, comprising the steps of hot forging a steel product having the chemical composition described above in (2), and nitriding the steel product without thermal refining, so as to nitride the surface portion of the steel product thereby forming a nitrided case.

(11) A manufacturing method of a nitrided steel part, comprising the step of nitriding the steel product for nitriding described above in (3), without thermal refining, so as to nitride the surface portion of the steel product thereby forming a nitrided case.

(12) A manufacturing method of a nitrided steel part, comprising the step of nitriding the steel product for nitriding described above in (4), without thermal refining, so as to nitride the surface portion of the steel product thereby forming a nitrided case.

DETAILED DESCRIPTION OF THE INVENTION

Figure 1:
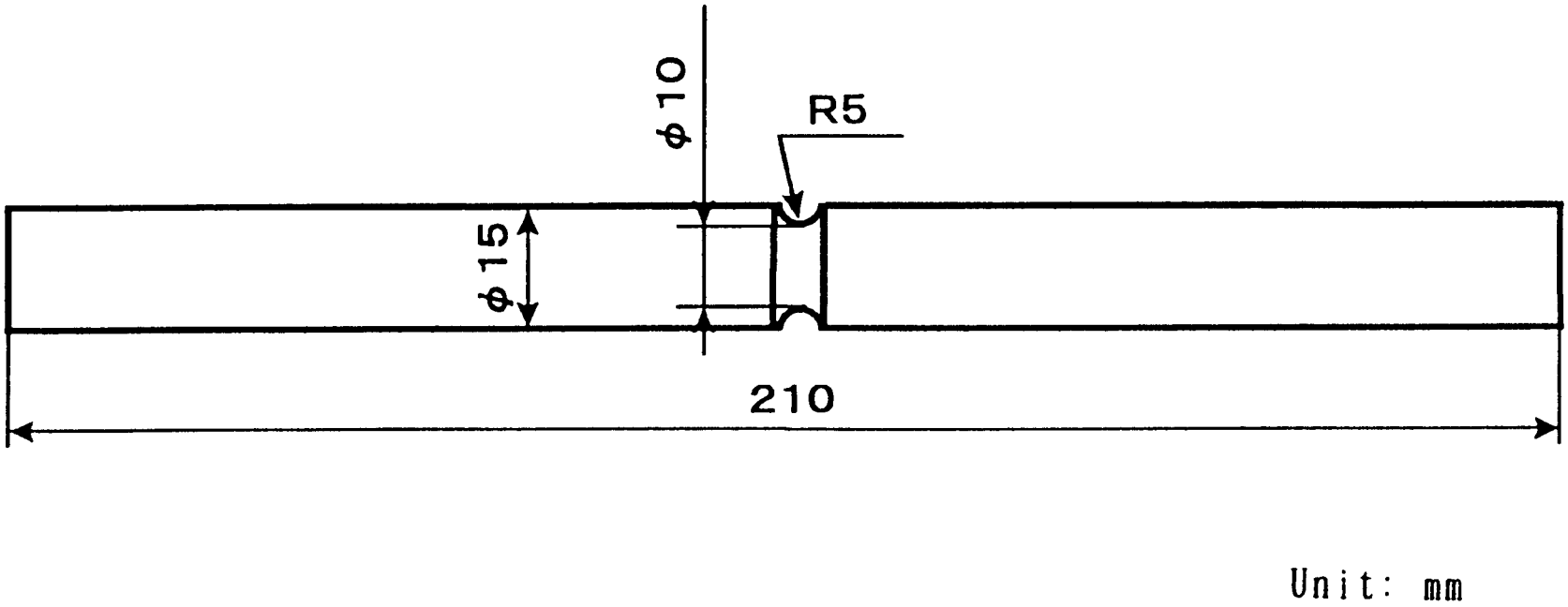
FIG. 1 is a view showing a test piece used in Example 2 for the Ono-type rotating bending fatigue test and the 3-points bending test.

The inventors of the present invention conducted extensive studies on the relation between the chemical compositions and microstructures of steel products to be subjected to nitriding without thermal refining and the mechanical properties (fatigue strength, tensile strength, and bending toughness) of the nitrided steel products. The invention has been accomplished based on their findings described below.

(a) A nitrided case formed by nitriding is composed of an outermost compound layer and a diffusion layer which underlies the compound layer. When a steel part undergoes nitriding without thermal refining, the initiation site of fatigue fracture is located at the boundary between the diffusion layer and the core. Cracking involved in straightening a steel part which has undergone nitriding without thermal refining occurs in the diffusion layer. The core refers to the portion of a nitrided part which is not hardened by nitriding. Hereinafter, a microstructure as observed before nitriding is referred to as core structure.

(b) A tensile residual stress occurs in the vicinity of the boundary between the diffusion layer and the core in a steel part which has undergone nitriding without thermal refining. To improve the fatigue strength of the steel part, the tensile residual stress must be reduced, or desirably, converted to a compressive residual stress.

(c) In a steel part which has undergone nitriding without thermal refining, hardness is significantly high in the surface thereof and reduces sharply with depth even when the chemical composition of steel does not include a precipitation hardening element. This implies that in the steel part, nitrogen fed from outside has difficulty in penetrating deep thereinto and remains in the surface thereof. To reduce a high tensile residual stress in the boundary portion between the diffusion layer and the core, it is important that nitrogen atoms diffuse deep thereinto to thereby ease the hardness gradient.

(d) Nitrogen diffuses at a high rate in ferrite, but at a significantly low rate in pearlite since lamellar cementite blocks the diffusion. Accordingly, for nitrogen to sufficiently diffuse into a steel part which has undergone nitriding without thermal refining in order to reduce a high tensile residual stress in the boundary portion between the diffusion layer and the core, the core microstructure must be appropriately adjusted.

(e) In a nitrided steel part, bending toughness is also closely related to the core microstructure. That is, when a microstructure composed of ferrite and pearlite (hereinafter referred to as "ferrite-pearlite structure") contains bainite or martensite, bending toughness is significantly impaired. Accordingly, to impart good bending toughness to a nitrided steel part, the core microstructure may as well be adjusted so as to assume the ferrite-pearlite microstructure.

(f) When the length of a crack, formed in a nitrided steel part caused by 1.5% tensile strain during straightening operation, is not longer than 0.10 mm, the crack does not raise any practical problem.

(g) Measuring the length of a crack formed during straightening operation requires the cutting of a test piece. However, by taking appropriate measures so as to obtain a critical cracking stroke of not less than 6 mm as measured by the 3-points bending test, which will be described later, performed on a test specimen shown in FIG. 1, the length of a crack, formed in a nitrided steel part caused by 1.5% tensile strain during the straightening operation, becomes 0.10 mm or shorter.

(h) As the surface hardness of a nitrided steel part increases, a tendency toward cracking during the straightening operation increases, and the length of a formed crack becomes longer. However, the length of a crack is not unconditionally determined by surface hardness.

(i) A crack formed during the straightening operation tends to progress in pearlite grain units. Accordingly, by reducing the size of a pearlite grain, the length of a crack formed in a nitrided steel part caused by 1.5% tensile strain during the straightening operation can be reduced to 0.10 mm or shorter.

(j) Through addition of a minute amount of Ti, the growth of austenite grains can be suppressed during heating for hot working such as forging, and thus bending toughness can be improved.

(k) When the ferrite percentage (an area percentage as observed through an optical microscope) in the ferrite-pearlite microstructure of a steel having a certain chemical composition is not less than 10%, there is obtained a desired critical cracking stroke of not less than 6 mm as measured by the 3-point bending test, which will be described later, performed on a test piece shown in FIG. 1, so that a bend caused by nitriding can be easily straightened.

(l) In the ferrite-pearlite microstructure of a steel having a certain chemical composition, fatigue strength interrelates with fn1 represented by the aforementioned Equation (1).

(m) When the value of fn1 represented by the aforementioned Equation (1) is not less than 150, a desired fatigue strength of 382 MPa, as measured by the Ono-type rotating bending fatigue test, is reliably obtained.

(n) When the ferrite percentage is not less than 10% in the ferrite-pearlite microstructure of a steel having a certain chemical composition, fn2 represented by the aforementioned Equation (2) interrelates with bending toughness (cracking characteristics as measured by the 3-points bending test, which will be described later, performed on a test piece shown in FIG. 1).

(o) When the value of fn2 represented by the aforementioned Equation (2) is not less than 15, a quite good bending toughness is obtained.

(p) P (phosphorus) contained in the chemical composition of a steel has an effect of improving the fatigue strength of a steel part which has undergone nitriding without thermal refining, with no accompanying increase in the length of a crack formed in the steel part by bending.

Requirements of the present invention will now be described in detail. The symbol "%" indicative of the content of each element means "% by weight".

(A) Chemical Composition

C: C is an element effective for imparting a desired tensile strength to a steel part (product) which has undergone nitriding without thermal refining, and must be contained in excess of 0.20% so as to impart a desired tensile strength to the steel part. However, if the carbon content is in excess of 0.60%, toughness and fatigue strength will be impaired. Further, bending toughness will also be impaired. As a result, when a bend caused by nitriding is straightened (tensile strain: 1.5%), there may be formed a crack whose length is far in excess of 0.10 mm. Therefore, the carbon content shall be over 0.20% to 0.60%. When the microstructure as observed before nitriding is not specified, the carbon content shall be, desirably, from 0.30% to 0.40%. By contrast, when the microstructure as observed before nitriding is specified, the carbon content shall be, desirably, from 0.30% to 0.50%.

Si: Si is an element effective for deoxidizing a steel. Further, Si has an effect of improving fatigue strength. However, if the silicon content is less than 0.05%, the effect of adding silicon will be poor. By contrast, if the silicon content is in excess of 1.0%, bending toughness will be impaired. Therefore, the silicon content shall be from 0.05% to 1.0%. Desirably, the silicon content shall be from 0.05% to 0.40%.

Mn: Mn is an element effective for deoxidizing a steel and for improving hardenability. Further, Mn has an effect of improving fatigue strength through improvement of nitriding characteristics and an effect of preventing impairment of high temperature ductility which would otherwise be derived from contained S. However, if the manganese content is less than 0.20%, the advantageous effects will not be expected. By contrast, if the manganese content is in excess of 1.50%, bending toughness will be impaired, resulting in a problem that there may be formed a crack whose length is far in excess of 0.10 mm when a bend caused by nitriding is straightened (tensile strain: 1.5%). Therefore, the manganese content shall be from 0.20% to 1.50%. When the microstructure as observed before nitriding is not specified, the manganese content shall be, desirably, from 0.20% to 0.60%. By contrast, when the microstructure as observed before nitriding is specified, the manganese content shall be, desirably, from 0.30% to 1.40%, and more desirably, the manganese content shall be from 0.30% to 1.00%.

P: P may be intentionally added for the purpose of improving fatigue strength of a steel part which has undergone nitriding without thermal refining, without an increase of the length of a crack caused by bending. To reliably obtain this effect, the phosphorus content may be not less than 0.02%. However, if the phosphorus content is in excess of 0.08%, toughness is significantly impaired. Therefore, the phosphorus content shall be 0.08% or less.

S: S has an effect of improving machinability of a steel. However, if the sulfur content is less than 0.005%, the effect of adding sulfur will be poor. By contrast, if the sulfur content is in excess of 0.10%, fatigue strength and bending toughness will be significantly impaired. Therefore, the sulfur content shall be from 0.005% to 0.10%. When the microstructure as observed before nitriding is not specified, the sulfur content shall be, desirably, from 0.02% to 0.10%.

Cu: Cu has an impairing action on hot workability of a steel. In particular, if the copper content is in excess of 0.30%, hot workability will be significantly impaired. Therefore, the copper content shall be 0.30% or less.

Ni: Ni has an impairing action on machinability. Particularly, if the nickel content is in excess of 0.30%, machinability will be significantly impaired. Therefore, the nickel content shall be 0.30% or less.

Cr: Cr may not be added. Cr, if added, has an effect of improving fatigue strength through improvement of nitriding characteristics. To reliably obtain this effect, the chromium content may be not less than 0.03%. However, if the chromium content is in excess of 0.30%, bending toughness will be significantly impaired. Therefore, the chromium content shall be 0.30% or less. When the microstructure as observed before nitriding is not specified, in order to obtain a particularly excellent bending toughness, the chromium content shall be, desirably, not greater than 0.10%.

Mo: Mo may not be added. Mo, if added, has an effect of improving toughness. To reliably obtain this effect, the molybdenum content may be not less than 0.01%. However, even when molybdenum is added in excess of 0.30%, the effect of addition of molybdenum is saturated, thus impairing cost effectiveness. Therefore., the molybdenum content shall be 0.30% or less.

V: V may not be added. V, if added, generates vanadium-carbonitride to thereby improve nitriding characteristics, resulting in the improvement of fatigue strength. However, if the vanadium content is in excess of 0.20%, bending toughness will be impaired, resulting in a problem that there may be formed a crack whose length is far in excess of 0.10 mm when a bend caused by nitriding is straightened (tensile strain: 1.5%). Therefore, the vanadium content shall be 0.20% or less. When the microstructure as observed before nitriding is specified, a vanadium content of not less than 0.01% will reliably provide a large fatigue strength and good bending toughness. In particular, when the value of fn2 represented by the aforementioned Equation (2) is also specified, a large fatigue strength and a particularly excellent bending toughness will reliably be provided. However, when the microstructure as observed before nitriding is not specified, in order to reliably obtain excellent bending toughness, V shall be preferably contained in the form of unavoidable impurities in an amount of less than 0.010%.

Nb: Nb may not be added. Nb, if added, generates NbN to thereby improve nitriding characteristics. However, if the niobium content is in excess of 0.05%, bending toughness will be impaired, resulting in a problem that there is formed a crack whose length is far in excess of 0.10 mm when a bend caused by nitriding is straightened (tensile strain: 1.5%). Therefore, the niobium content shall be 0.05% or less. When the microstructure as observed before nitriding is specified, a niobium content of not less than 0.003% will reliably provide good nitriding characteristics and excellent bending toughness. In particular, when the value of fn2 represented by the aforementioned Equation (2) is also specified, good nitriding characteristics and a particularly excellent bending toughness will reliably be provided. However, even in this case, the niobium content shall be, desarably, limited to up to 0.02% in order to reliably obtain a particularly excellent bending toughness. When the microstructure as observed before nitriding is not specified, in order to reliably obtain excellent bending toughness, Nb shall be preferably contained in the form of unavoidable impurities in an amount of less than 0.010%.

Ti: Ti may not be added. Ti, if added, improves bending toughness through refinement of grains and has an effect of improving nitriding characteristics. To reliably obtain these effects, the titanium content may be not less than 0.003%. However, if the titanium content is in excess of 0.03%, bending toughness will be impaired, resulting in a problem that there is formed a crack whose length is far in excess of 0.10 mm when a bend caused by nitriding is straightened (tensile strain: 1.5%). Therefore, the titanium content shall be 0.03% or less. When the microstructure as observed before nitriding is not specified, the titanium content shall be, desirably, from 0.005% to 0.013%.

Al: Al is an effective element as a deoxidizer, but impairs bending toughness. In particular, when the aluminum content is in excess of 0.08%, bending toughness is significantly impaired. Therefore, the aluminum content shall be 0.08% or less. When the microstructure as observed before nitriding is not specified, in order to obtain a particularly excellent bending toughness, the upper limit to aluminum content shall be, desirably, 0.005%. In this specification, "Al" refers to so-called "acid-soluble Al (sol. Al)".

Ca: Ca may not be added. Ca, if added, has an effect of improving machinability. To reliably obtain this effect, the calcium content may be not less than 0.0003%. However, if the calcium content is in excess of 0.005%, fatigue strength and bending toughness will be significantly impaired. Therefore, the calcium content shall be 0.005% or less. When the microstructure as observed before nitriding is not specified, in order to obtain excellent fatigue characteristic and bending toughness, the upper limit to calcium content shall be, desirably, 0.0030%.

Pb: Pb may not be added. Pb, if added, has an effect of improving machinability. To reliably obtain this effect, the lead content may be not less than 0.03%. However, if the lead content is in excess of 0.30%, fatigue characteristics and bending toughness will be impaired. Therefore, the lead content shall be 0.30% or less. When the microstructure as observed before nitriding is not specified, in order to obtain good fatigue characteristics and bending toughness, the lead content shall be, desirably, not greater than 0.20%.

N: N is an element effective for refining grains through generation of a nitride. However, this effect is not sufficiently expected when the nitrogen content is less than 0.008%. By contrast, even when the nitrogen content is in excess of 0.030%, the effect is saturated. Therefore, the nitrogen content shall be from 0.008% to 0.030%. When the microstructure as observed before nitriding is not specified, the nitrogen content shall be, desirably, from 0.010% to 0.030%. By contrast, when the microstructure as observed before nitriding is specified, the nitrogen content shall be, desirably, from 0.008% to 0.020%.

fn1: Fatigue strength interrelates with fn1 represented by the aforementioned Equation (1) in the ferrite-pearlite microstructure, particularly in the ferrite-pearlite microstructure having a ferrite percentage of not less than 10%, of a steel having the following chemical composition: C: over 0.20 to 0.60%, Si: 0.05 to 1.0%, Mn: 0.30 to 1.50%,P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.03% or less, Al: 0.08% or less, Ca: 0.005% or less, Pb: 0.30% or less, and N: 0.008% to 0.020%. At an fn1 value of not less than 150, a desired fatigue strength of not less than 382 MPa is reliably obtained. Since machinability may be impaired at an fn1 value in excess of 260, the value of fn1 may shall be, desirably, not greater than 260.

fn2: Bending toughness interrelates with fn2 represented by the aforementioned Equation (2) in the ferrite-pearlite microstructure of a steel having a chemical composition identical to that described above in the paragraph about fn1. At an fn2 value of not less than 15, a particularly good bending toughness can be obtained. However, since static strength (tensile strength) may be impaired at an fn2 value in excess of 70, the value of fn2 shall be, desirably, not greater than 70. As described previously, fn2 interrelates with bending toughness only when the ferrite percentage in the ferrite-pearlite microstructure is not less than 10%.

(B) Microstructure

In a nitrided steel part, bending toughness is closely related to the core microstructure. When the ferrite-pearlite microstructure includes bainite or martensite, bending toughness is significantly impaired. Accordingly, to impart good bending toughness to a nitrided steel part, the core microstructure shall be, desirably, adjusted so as to assume the ferrite-pearlite microstructure. As mentioned previously, the core refers to the portion of a nitrided steel part which is not hardened by nitriding, and the core microstructure refers to a microstructure as observed before nitriding.

Even when the core has the ferrite-pearlite microstructure, if the ferrite percentage (an area percentage as observed through an optical microscope) is less than 10%, there is not obtained bending toughness corresponding to a critical cracking stroke of not less than 6 mm as measured by the 3-points bending test performed on a test piece shown in FIG. 1. Therefore, when the microstructure as observed before nitriding is specified, the ferrite percentage in the ferrite-pearlite microstructure shall be not less than 10%. Since fatigue strength may be impaired at a ferrite percentage in excess of 70% in the ferrite-pearlite microstructure, the ferrite percentage shall be, desirably, not greater than 70%.

For a steel product formed from a steel having the chemical composition shown above in (A), the paragraph about fn1, the ferrite-pearlite microstructure having a ferrite percentage of not less than 10% is easily obtained according to the steps of heating the steel, hot working the heated steel to a desired shape of a nitrided steel part, and cooling the hot-worked piece at a cooling rate not higher than air cooling. In the heating step, the steel may be heated at a temperature ranging from 1200° C. to 1300° C. The hot working step is not particularly limited, but may be normally practiced working such as hot forging. The hot working step may be followed, as needed, by machining such as cutting.

A "steel product for nitriding" according to the present invention is obtained by the above-described manufacturing method. This steel product undergoes nitriding described below to become a "nitrided steel part" according to the present invention.

For a steel product whose microstructure as observed before nitriding is not specified and whose core is a steel having the chemical composition shown above in (A), the paragraph about fn1, the steel product is formed according to the steps of heating the steel and forging the heated steel to a desired shape. The forging step is not particularly limited, but may be normally practiced working. The forging step may be followed, as needed, by machining such as cutting. The steel product formed into a desired shape undergoes nitriding described below to become a "nitrided steel part" according to the present invention.

(C) Nitriding

The above-described steel part having a desired shape (a steel product for nitriding) is subjected to nitriding so as to form a hard, deep nitrided case therein. Thus is obtained a nitrided steel part having high strength (tensile strength and fatigue strength) and excellent bending toughness. This nitriding step is not particularly limited, but may be performed according to a normal method.

High strength (tensile strength and fatigue strength) and excellent bending toughness can be imparted to the above-described steel part having a desired shape (a steel product for nitriding) merely through nitriding without thermal refining.

Generally, nitriding refers to so-called "gas nitriding", in which an object is heated at a temperature of 500 to 550° C. for 20 to 100 hours in an ammonia stream. Thus, gas nitriding has drawbacks of low productivity and high cost. Liquid nitriding is also developed in which nitriding is performed at a temperature of approximately 550° C. However, since liquid nitriding requires approximately 12 hours for nitriding, this method is not suited for efficiently mass-producing steel parts at low cost. Ion nitriding enables short-time nitriding, but has a drawback that temperature is difficult to measure and that temperature and a nitrided case becomes unstable depending on the arrangement, shape, and mass of a steel part to be nitrided, the steel part serving as a cathode. Thus, ion nitriding is also unsuited for mass-producing steel parts.

By contrast, according to soft-nitriding, a steel product is placed in a salt bath containing a cyanic Compound having a temperature of approximately 570° C. or held in the RX gas (a trademark of an endothermic converted gas) containing ammonia, whereby N (nitrogen) and C (carbon) penetrate into the steel product from its surface to thereby harden its surface portion. Soft-nitriding can finish nitriding in a short-period of time. Accordingly, soft-nitriding is preferred for nitriding steel products. The former soft-nitriding using a salt bath containing a cyanic compound is referred to as so-called "Tufftriding", whereas the latter soft-nitriding using a gas is referred to as "gas soft-nitriding".

Surface hardness (herein, Hv hardness as measured at a depth of 0.025 mm below surface) and case depth (herein, distance from surface to a position where the hardness of core is measured) as measured after nitriding are not particularly limited. However, surface hardness is preferably 600 to 900 on the Hv scale, and case depth is preferably not less than 0.1 mm in view of fatigue strength. More preferably, case depth is not less than 0.3 mm.

Nitrided steel parts according to the present invention may undergo grinding or polishing as needed.

EXAMPLES

The present invention is described concretely using examples, which should not be construed as limiting the present invention thereto.

Example 1

Steels having a chemical composition shown in Table 1 were manufactured by a normal method through use of a 50 kg test furnace. In Table 1, steels Z1 to Z3 and Z5 to Z8 are examples of the present invention and contain each component element in an amount falling in a range specified by the present invention. Steels Z12, Z14 and Z15 are comparative examples in which any of component elements falls outside the range specified by the present invention.

TABLE 1

| | Chemical composition (percent by weight) Balance: Fe and unavoidable impurities | | | | | | | | | | | |
|---|---|---|---|---|---|---|---|---|---|---|---|---|
| Steel | C | Si | Mn | P | S | Cr | V | Ti | Al | Ca | Pb | N |
| Z1 | 0.31 | 0.05 | 0.5 | 0.02 | 0.045 | 0.05 | 0.001 | 0.008 | 0.005 | 0.0005 | — | 0.018 |
| Z2 | 0.31 | 0.2 | 0.3 | 0.03 | 0.022 | 0.02 | 0.002 | 0.005 | 0.004 | 0.0003 | — | 0.019 |
| Z3 | 0.35 | 0.38 | 0.40 | 0.075 | 0.031 | 0.01 | 0.005 | 0.006 | 0.005 | 0.0005 | — | 0.011 |
| Z5 | 0.39 | 0.05 | 0.42 | 0.022 | 0.055 | 0.08 | <0.001 | 0.009 | 0.003 | 0.0008 | 0.03 | 0.016 |
| Z6 | 0.35 | 0.15 | 0.20 | 0.021 | 0.020 | 0.09 | 0.009 | 0.005 | 0.003 | 0.0005 | — | 0.014 |
| Z7 | 0.33 | 0.15 | 0.48 | 0.031 | 0.052 | 0.03 | <0.001 | 0.005 | 0.002 | 0.0004 | — | 0.015 |
| Z8 | 0.35 | 0.30 | 0.58 | 0.035 | 0.092 | 0.03 | 0.002 | 0.006 | 0.005 | 0.0025 | 0.15 | 0.019 |
| Z12 | 0.38 | 0.20 | 0.15 | 0.025 | 0.045 | 0.09 | 0.001 | 0.006 | 0.003 | 0.0019 | — | 0.013 |
| Z14 | 0.35 | 0.22 | 0.40 | 0.090 | 0.044 | 0.05 | <0.001 | 0.009 | 0.004 | 0.0003 | — | 0.012 |
| Z15 | 0.36 | 0.19 | 0.39 | 0.050 | 0.120 | 0.04 | 0.001 | 0.007 | 0.003 | 0.0003 | — | 0.011 |

The underlined values fall outside the ranges specified by the present invention.

Next, the thus-manufactured steels were formed into ingots by a normal method. Then, the ingots were heated to a temperature of 1250° C. and hot forged into round bars having a diameter of 30 mm at a temperature of 1250° C. to 900° C. After being hot forged at 900° C. the round bars were subjected atmospheric cooling.

From each of the thus-obtained round bars having a diameter of 30 mm, JIS No. 1 Ono-type rotating bending fatigue test specimens (8 mm diameter) were obtained and subjected to gas soft-nitriding for fatigue test use, and round bars having a diameter of 20 mm and a length of 400 mm were obtained and subjected to gas soft-nitriding for bending test use.

For gas soft-nitriding, the thus-obtained test specimens were heated to a temperature of 570° C. in an atmosphere consisting of $N_2$ and $NH_3$ in the ratio 1:1 and held at the temperature for 3 hours, followed by cooling in oil having a temperature of 150° C. The thus-soft-nitrided test specimens were used for respective tests.

The fatigue test was carried out in air at room temperature at a cycling rate of 50 Hz. The stress amplitude when the number of cycles to fracture reached $10^7$ was defined as the fatigue strength (fatigue limit) for evaluation use.

Straightening operability (bending toughness) was evaluated by the 3-points bending test performed on a relevant test specimen, i.e. a round bar having a diameter of 20 mm and a length of 400 mm. A strain gauge was stuck onto the test specimen, which was then loaded at room temperature in the atmosphere under the following conditions: a span length of 200 mm and a strain rate of $1\times10^{-4}$/sec. Thereafter, when the amount of strain reaches 1.5% at a portion where strain is maximized, the test specimen was unloaded. The test specimen was cut in cross section, and the length of a crack formed in the diffusion layer was measured.

Further, the forged round bars having a diameter of 30 mm underwent a machinability test through use of a lathe. The round bars were lathed through use of a square chip of Igetalloy ST20E (trademark) under the following conditions: dry, a cutting speed of 160 m/min, a feed of 0.25 mm/rev, and a depth of cut of 2.0 mm. Machinability was evaluated in terms of tool life. The tool life was represented by time which elapses until flank wear VB reaches 0.2 mm.

Table 2 shows the results of the fatigue, 3-points bending, and machinability tests. As seen from Table 2, the steels serving as examples of the present invention meet the requirements for fatigue strength and bending toughness, namely, exhibit a fatigue strength of not less than 382 MPa (39 kgf/mm$^2$) at the Ono-type rotating bending fatigue test and a bending toughness of not greater than 0.10 mm in the length of a crack at straightening operation (tensile strain: 1.5%).

TABLE 2

| Steel | Fatigue strength (MPa) | Crack length (mm) | Machinability |
|---|---|---|---|
| Z1 | 392 | 0.08 | x |
| Z2 | 382 | 0.06 | x |
| Z3 | 382 | 0.08 | x |
| Z4 | 382 | 0.06 | ○ |
| Z6 | 382 | 0.09 | x |
| Z7 | 392 | 0.04 | x |
| Z8 | 382 | 0.05 | ○ |
| *Z12 | **343 | 0.04 | x |
| *Z14 | 382 | **0.11 | x |
| *Z15 | **353 | 0.09 | x |

*:The chemical composition of steel does not conform to the present invention.
**:The value falls outside the required ranges.

By contrast, the steels of the comparative examples do not concurrently meet the requirement for fatigue strength and the requirement for the length of a crack caused by bending.

Table 2 shows the machinability test results by the symbols "circle" and "X" based on the machinability or tool life of a steel formed by adding 0.05% of Pb to JIS-specified S48C steel and subjected to refining, wherein "circle" shows tool life equivalent to or better than the reference tool life, and "X" shows tool life inferior to the reference tool life. Among the steels serving as examples of the present invention, those containing Pb are found not only to meet the requirements for fatigue strength and bending toughness but also to exhibit good machinability.

Example 2

Steels having a chemical composition shown in Tables 3 to 6 were manufactured by a normal method through use of a 50 kg test furnace. Steels 1 to 32 in Tables 3 and 4 are examples of the present invention, and contain each component element in an amount falling in a range specified by the present invention. Steels 33 to 54 in Tables 5 and 6 are comparative examples, in which any of component elements falls outside a range specified by the present invention.

TABLE 3

| | Chemical composition (percent by weight) Balance: Fe and unavoidable impurities | | | | | | | | | | | | | | | | | |
|---|---|---|---|---|---|---|---|---|---|---|---|---|---|---|---|---|---|---|
| Steel | C | Si | Mn | P | S | Cu | Ni | Cr | Mo | V | Nb | Ti | Al | Ca | Pb | N | fn1 | fn2 |
| 1 | 0.40 | 0.17 | 0.50 | 0.007 | 0.055 | 0.01 | 0.02 | 0.05 | 0.02 | — | — | 0.001 | 0.003 | 0.0011 | 0.11 | 0.0151 | 174.2 | 64.0 |
| 2 | 0.31 | 0.81 | 0.63 | 0.012 | 0.037 | — | 0.01 | 0.03 | 0.03 | 0.01 | 0.010 | 0.009 | 0.002 | 0.0046 | 0.08 | 0.0183 | 165.6 | 58.6 |
| 3 | 0.38 | 0.22 | 0.45 | 0.024 | 0.049 | 0.02 | 0.01 | — | 0.01 | 0.12 | 0.002 | 0.002 | 0.001 | 0.0008 | 0.07 | 0.0174 | 163.2 | 47.8 |
| 4 | 0.43 | 0.63 | 0.51 | 0.018 | 0.071 | 0.02 | 0.02 | 0.06 | 0.29 | — | 0.001 | — | — | 0.0012 | — | 0.0129 | 181.4 | 30.6 |
| 5 | 0.35 | 0.25 | 0.74 | 0.014 | 0.051 | 0.26 | 0.01 | — | 0.01 | 0.01 | 0.046 | 0.001 | — | 0.0013 | 0.09 | 0.0136 | 183.5 | 40.9 |
| 6 | 0.38 | 0.05 | 0.48 | 0.025 | 0.044 | 0.05 | 0.05 | 0.01 | 0.04 | 0.01 | 0.001 | — | 0.002 | 0.0009 | 0.16 | 0.0146 | 165.7 | 43.6 |
| 7 | 0.59 | 0.18 | 0.31 | 0.006 | 0.067 | 0.03 | — | — | — | — | 0.002 | 0.010 | 0.075 | — | 0.28 | 0.0198 | 194.6 | 17.6 |
| 8 | 0.37 | 0.08 | 0.88 | 0.044 | 0.048 | — | 0.11 | 0.02 | 0.07 | 0.02 | 0.001 | 0.003 | — | 0.0011 | 0.16 | 0.0166 | 204.0 | 30.5 |
| 9 | 0.42 | 0.38 | 0.53 | 0.009 | 0.051 | 0.01 | — | 0.27 | 0.18 | 0.18 | 0.001 | 0.001 | 0.008 | 0.0015 | — | 0.0118 | 191.2 | 26.2 |
| 10 | 0.55 | 0.72 | 0.46 | 0.031 | 0.026 | 0.11 | 0.07 | 0.03 | 0.02 | — | — | 0.006 | 0.065 | — | 0.13 | 0.0178 | 202.3 | 16.3 |
| 11 | 0.41 | 0.25 | 0.32 | 0.049 | 0.027 | — | 0.26 | — | 0.06 | 0.02 | — | 0.005 | 0.033 | — | 0.10 | 0.0195 | 157.2 | 49.3 |
| 12 | 0.23 | 0.98 | 0.88 | 0.009 | 0.005 | 0.03 | 0.08 | 0.11 | 0.01 | — | 0.003 | 0.029 | 0.001 | 0.0017 | 0.11 | 0.0095 | 165.8 | 66.7 |
| 13 | 0.47 | 0.51 | 0.46 | 0.012 | 0.039 | — | 0.08 | 0.04 | 0.01 | 0.15 | 0.001 | 0.002 | 0.004 | 0.0011 | 0.05 | 0.0107 | 182.3 | 24.4 |
| 14 | 0.39 | 0.25 | 0.40 | 0.036 | 0.081 | 0.02 | 0.02 | — | 0.11 | — | 0.031 | 0.002 | 0.053 | — | 0.13 | 0.0136 | 158.2 | 56.8 |
| 15 | 0.29 | 0.46 | 0.51 | 0.022 | 0.014 | 0.08 | 0.01 | 0.14 | — | 0.01 | 0.002 | — | 0.005 | 0.0012 | 0.15 | 0.0155 | 156.1 | 57.3 |
| 16 | 0.50 | 0.37 | 0.52 | 0.018 | 0.041 | 0.03 | 0.01 | 0.03 | — | — | 0.011 | 0.001 | 0.004 | 0.0010 | 0.06 | 0.0161 | 197.8 | 20.3 |
| 17 | 0.48 | 0.30 | 0.80 | 0.021 | 0.043 | 0.03 | 0.03 | 0.09 | 0.01 | — | — | — | 0.002 | 0.0014 | 0.11 | 0.0082 | 220.1 | 7.3 |

fn1 = 221C + 99.5Mn + 52.5Cr − 304Ti + 577N + 25
fn2 = −192C − 32.8Mn − 25.1Cr + 467Ti + 726N + 122
The symbol of an element appearing in the above equations indicates the content of the element.

TABLE 4

| Steel | Chemical composition (percent by weight) Balance: Fe and unavoidable impurities | | | | | | | | | | | | | | | | | |
|---|---|---|---|---|---|---|---|---|---|---|---|---|---|---|---|---|---|---|
| | C | Si | Mn | P | S | Cu | Ni | Cr | Mo | V | Nb | Ti | Al | Ca | Pb | N | fn1 | fn2 |
| 18 | 0.24 | 0.18 | 1.10 | 0.008 | 0.049 | 0.01 | 0.01 | 0.05 | 0.01 | — | — | 0.011 | 0.003 | 0.0013 | 0.09 | 0.0153 | 195.6 | 54.8 |
| 19 | 0.30 | 0.76 | 1.08 | 0.014 | 0.055 | — | — | 0.25 | 0.03 | — | 0.046 | 0.007 | 0.007 | 0.0010 | 0.16 | 0.0175 | 219.9 | 38.7 |
| 20 | 0.36 | 0.06 | 1.08 | 0.036 | 0.041 | — | — | — | 0.05 | — | 0.008 | — | — | 0.0009 | 0.08 | 0.0143 | 220.3 | 27.8 |
| 21 | 0.26 | 0.17 | 1.11 | 0.015 | 0.029 | 0.28 | 0.08 | 0.16 | — | 0.16 | 0.025 | 0.009 | 0.051 | — | 0.18 | 0.0083 | 203.4 | 41.9 |
| 22 | 0.31 | 0.21 | 1.49 | 0.018 | 0.007 | — | — | 0.11 | 0.01 | 0.02 | — | 0.028 | 0.004 | 0.0012 | — | 0.0179 | 249.4 | 36.9 |
| 23 | 0.30 | 0.25 | 1.42 | 0.019 | 0.016 | 0.02 | 0.11 | 0.03 | — | — | — | 0.013 | — | 0.0018 | 0.09 | 0.0085 | 235.1 | 29.3 |
| 24 | 0.37 | 0.21 | 1.09 | 0.022 | 0.056 | 0.15 | — | 0.28 | — | 0.03 | — | — | 0.005 | 0.0015 | — | 0.0166 | 239.5 | 20.2 |
| 25 | 0.33 | 0.29 | 1.14 | 0.016 | 0.019 | — | 0.29 | 0.18 | — | — | 0.006 | 0.005 | — | 0.0008 | 0.20 | 0.0172 | 229.2 | 31.6 |
| 26 | 0.25 | 0.50 | 1.02 | 0.042 | 0.052 | 0.05 | 0.02 | 0.05 | 0.08 | 0.01 | 0.007 | 0.006 | 0.075 | — | 0.27 | 0.0124 | 189.7 | 51.1 |
| 27 | 0.21 | 0.17 | 1.23 | 0.017 | 0.028 | — | — | — | 0.10 | — | — | 0.011 | 0.021 | — | 0.10 | 0.0155 | 199.4 | 57.8 |
| 28 | 0.34 | 0.38 | 1.03 | 0.012 | 0.049 | 0.08 | 0.02 | 0.22 | — | 0.08 | — | — | 0.002 | 0.0022 | — | 0.0197 | 225.5 | 31.7 |
| 29 | 0.35 | 0.99 | 1.05 | 0.003 | 0.036 | 0.03 | — | 0.21 | 0.27 | — | 0.007 | 0.014 | 0.008 | 0.0017 | 0.15 | 0.0168 | 223.3 | 33.8 |
| 30 | 0.22 | 0.16 | 1.11 | 0.036 | 0.095 | — | 0.08 | — | 0.07 | — | 0.005 | 0.010 | — | — | 0.06 | 0.0149 | 189.6 | 58.9 |
| 31 | 0.28 | 0.41 | 1.18 | 0.013 | 0.041 | 0.01 | 0.06 | 0.04 | 0.15 | 0.01 | — | 0.009 | 0.009 | 0.0016 | 0.13 | 0.0186 | 214.4 | 46.2 |
| 32 | 0.35 | 0.39 | 1.48 | 0.009 | 0.047 | 0.03 | 0.02 | 0.09 | 0.01 | — | — | — | — | — | 0.05 | 0.0093 | 259.7 | 10.7 |

fn1 = 221C + 99.5Mn + 52.5Cr − 304Ti + 577N + 25
fn2 = −192C − 32.8Mn − 25.1Cr + 467Ti + 726N + 122
The symbol of an element appearing in the above equations indicates the content of the element.

TABLE 5

| Steel | Chemical composition (percent by weight) Balance: Fe and unavoidable impurities | | | | | | | | | | | | | | | | | |
|---|---|---|---|---|---|---|---|---|---|---|---|---|---|---|---|---|---|---|
| | C | Si | Mn | P | S | Cu | Ni | Cr | Mo | V | Nb | Ti | Al | Ca | Pb | N | fn1 | fn2 |
| 33 | 0.18 | 0.25 | 0.88 | 0.025 | 0.021 | — | — | 0.02 | 0.01 | — | — | — | 0.024 | — | 0.17 | 0.0095 | 158.9 | 65.0 |
| 34 | 0.62 | 0.36 | 0.35 | 0.037 | 0.019 | 0.04 | — | 0.01 | 0.03 | 0.01 | 0.003 | 0.025 | 0.008 | — | — | 0.0193 | 200.9 | 16.9 |
| 35 | 0.36 | 0.28 | 0.58 | 0.026 | 0.104 | 0.01 | 0.02 | 0.06 | 0.05 | — | 0.025 | — | — | 0.0012 | — | 0.0194 | 176.6 | 46.4 |
| 36 | 0.45 | 0.46 | 0.41 | 0.033 | 0.055 | 0.01 | — | 0.33 | — | 0.02 | — | 0.009 | 0.006 | 0.0021 | 0.11 | 0.0095 | 185.3 | 25.0 |
| 37 | 0.27 | 0.51 | 0.61 | 0.006 | 0.049 | 0.17 | 0.01 | 0.01 | 0.02 | — | — | 0.001 | 0.085 | — | 0.09 | 0.0175 | 155.7 | 63.1 |
| 38 | 0.41 | 0.36 | 0.55 | 0.028 | 0.014 | — | — | 0.03 | — | 0.12 | 0.014 | 0.035 | 0.004 | 0.0006 | — | 0.0144 | 169.6 | 51.3 |
| 39 | 0.48 | 0.25 | 0.35 | 0.036 | 0.043 | 0.12 | 0.11 | — | 0.03 | 0.24 | 0.006 | 0.002 | 0.041 | — | — | 0.0108 | 171.5 | 27.1 |
| 40 | 0.34 | 0.36 | 0.72 | 0.018 | 0.065 | — | — | 0.02 | 0.05 | 0.05 | 0.053 | — | — | 0.0024 | 0.08 | 0.0128 | 180.2 | 41.9 |
| 41 | 0.48 | 0.84 | 0.63 | 0.029 | 0.018 | 0.05 | 0.03 | 0.01 | 0.01 | — | 0.009 | — | 0.025 | 0.0058 | 0.12 | 0.0157 | 203.3 | 20.3 |
| 42 | 0.43 | 0.27 | 0.84 | 0.014 | 0.036 | — | — | — | — | — | — | 0.008 | — | 0.0011 | 0.32 | 0.0105 | 207.2 | 23.2 |
| 43 | 0.46 | 1.07 | 0.36 | 0.029 | 0.027 | 0.03 | 0.02 | 0.04 | — | 0.09 | 0.002 | 0.002 | 0.034 | — | 0.15 | 0.0127 | 171.3 | 31.0 |

fn1 = 221C + 99.5Mn + 52.5Cr − 304Ti + 577N + 25
fn2 = −192C − 32.8Mn − 25.1Cr + 467Ti + 726N + 122
The symbol of an element appearing in the above equations indicates the content of the element.
The underlined values fall outside the ranges specified by the present invention.

TABLE 6

| Steel | Chemical composition (percent by weight) Balance: Fe and unavoidable impurities | | | | | | | | | | | | | | | | | |
|---|---|---|---|---|---|---|---|---|---|---|---|---|---|---|---|---|---|---|
| | C | Si | Mn | P | S | Cu | Ni | Cr | Mo | V | Nb | Ti | Al | Ca | Pb | N | fn1 | fn2 |
| 44 | 0.26 | 0.29 | 1.55 | 0.025 | 0.007 | 0.03 | 0.05 | 0.22 | — | 0.03 | 0.003 | — | 0.003 | — | — | 0.0089 | 253.4 | 22.2 |
| 45 | 0.20 | 0.07 | 1.27 | 0.018 | 0.103 | — | — | 0.24 | 0.21 | 0.01 | — | 0.011 | — | 0.0014 | 0.19 | 0.0146 | 213.2 | 51.7 |
| 46 | 0.29 | 0.18 | 1.02 | 0.026 | 0.048 | 0.05 | 0.08 | 0.34 | 0.05 | 0.15 | 0.006 | 0.006 | 0.004 | 0.0013 | 0.26 | 0.0122 | 197.6 | 36.0 |
| 47 | 0.28 | 0.92 | 1.21 | 0.048 | 0.091 | — | 0.22 | 0.16 | — | — | — | 0.023 | 0.086 | 0.0015 | — | 0.0097 | 214.3 | 42.3 |
| 48 | 0.20 | 0.86 | 1.11 | 0.028 | 0.016 | 0.25 | — | 0.27 | — | 0.02 | 0.041 | 0.037 | 0.016 | — | — | 0.0180 | 193.0 | 70.8 |
| 49 | 0.31 | 0.11 | 1.06 | 0.036 | 0.083 | — | — | 0.18 | 0.16 | 0.08 | 0.003 | 0.006 | — | 0.0008 | 0.15 | 0.0054 | 209.7 | *— |
| 50 | 0.33 | 0.28 | 1.24 | 0.019 | 0.044 | — | 0.11 | 0.07 | 0.08 | — | — | — | — | 0.0056 | 0.09 | 0.0113 | 231.5 | 24.4 |
| 51 | 0.25 | 0.36 | 1.05 | 0.029 | 0.019 | 0.01 | 0.07 | 0.23 | — | 0.11 | 0.002 | 0.008 | 0.027 | — | 0.34 | 0.0156 | 203.4 | 48.8 |
| 52 | 0.26 | 0.18 | 1.06 | 0.012 | 0.051 | 0.03 | — | 0.25 | 0.06 | 0.23 | — | — | — | 0.0024 | — | 0.0129 | 210.5 | 39.7 |

TABLE 6-continued

| Steel | Chemical composition (percent by weight) Balance: Fe and unavoidable impurities | | | | | | | | | | | | | | | | | |
|---|---|---|---|---|---|---|---|---|---|---|---|---|---|---|---|---|---|---|
| | C | Si | Mn | P | S | Cu | Ni | Cr | Mo | V | Nb | Ti | Al | Ca | Pb | N | fn1 | fn2 |
| 53 | 0.36 | 0.42 | 1.17 | 0.021 | 0.063 | — | 0.09 | 0.21 | 0.09 | 0.10 | 0.054 | 0.016 | 0.005 | 0.0019 | — | 0.0157 | 236.2 | 28.1 |
| 54 | 0.28 | 1.05 | 1.08 | 0.006 | 0.021 | 0.08 | 0.12 | 0.09 | 0.13 | 0.02 | 0.011 | 0.012 | 0.001 | 0.0011 | 0.08 | 0.0129 | 202.9 | 45.5 |

fn1 = 221C + 99.5Mn + 52.5Cr − 304Ti + 577N + 25
fn2 = −192C − 32.8Mn − 25.1Cr + 467Ti + 726N + 122
The symbol of an element appearing in the above equations indicates the content of the element.
The underlined values fall outside the ranges specified by the present invention.
*: For steel 49, fn2 does not hold because the ferrite percentage is less than 10%.

Next, the thus-manufactured steels were formed into billets by a normal method. Then, the billets were heated to a temperature of 1250° C. and hot forged into round bars having a diameter of 30 mm at a temperature of 1250° C. to 1000° C. After being hot forged at 1000° C., the round bars were subjected to air cooling.

From each of the thus-obtained round bars having a diameter of 30 mm, test specimens having the shape shown in FIG. 1, JIS No. 4 tensile test specimens, and test specimens having a diameter of 25 mm and a thickness of 20 mm for observation of microstructure were obtained by cutting.

The test specimens having the shape of FIG. 1 and the JIS No. 4 tensile test specimens were held for 3 hours in a mixed gas consisting of nitrogen gas and ammonia gas in the ratio 1:1 and having a temperature of 570° C., thereby being soft-nitrided. The thus-soft-nitrided test specimens were cooled in oil.

The soft-nitrided JIS No. 4 tensile test specimens were tested for tensile strength at room temperature.

The soft-nitrided test specimens having the shape of FIG. 1 were tested for fatigue strength and bending toughness by the Ono-type rotating bending fatigue test and 3-points bending test, respectively.

The Ono-type rotating bending fatigue test was carried out at room temperature and a rotational speed of 3000 rpm in the atmosphere so as to obtain fatigue strength (fatigue limit) of the test specimens. (The stress concentration factor of the above-mentioned test specimen is 1.4.)

Further, a strain gauge was stuck onto each of the soft-nitrided test specimens having the-shape of FIG. 1. Then, the test specimens underwent the 3-points bending test at room temperature in the atmosphere so as to obtain a critical stroke at which cracking occurs (critical cracking stroke), under the following test conditions: a span of 50 mm and a crosshead speed of 20 mm/min.

Also, the test specimens having a diameter of 25 mm and a thickness of 20 mm for observation of microstructure were observed through an optical microscope (200 magnifications) for the microstructure after hot working, which is equivalent to the core microstructure, thereby obtaining ferrite percentage. The steels 1 to 54 were found to have the ferrite-pearlite microstructure.

Tables 7 and 8 show the test results.

As seen from Table 7, in the steels 1 to 32 serving as examples of the present invention and having a chemical composition of the present invention and a ferrite-pearlite microstructure with a ferrite percentage of not less than 10%, a desired tensile strength of not less than 500 MPa, a desired fatigue strength of not less than 382 MPa, and a desired critical cracking stroke of not less than 6 mm are obtained. Among examples of the present invention, the steels 1 to 16 and 18 to 31 having an fn2 value of not less than 15 exhibit a large critical cracking stroke.

By contrast, in the steels 33 to 54 which serve as comparative examples and whose chemical compositions do not conform to the present invention, at least any one of tensile strength, fatigue strength, and critical cracking stroke falls outside a required range.

TABLE 7

| Steel | Ferrite percentage (%) | Tensile strength (MPa) | Fatigue strength (MPa) | Critical cracking stroke (mm) |
|---|---|---|---|---|
| 1 | 60.8 | 584 | 396 | 12.1 |
| 2 | 53.9 | 549 | 382 | 10.7 |
| 3 | 50.2 | 524 | 392 | 9.7 |
| 4 | 27.8 | 585 | 396 | 7.5 |
| 5 | 39.2 | 588 | 414 | 9.1 |
| 6 | 41.4 | 529 | 391 | 9.2 |
| 7 | 17.1 | 619 | 418 | 7.0 |
| 8 | 28.4 | 642 | 424 | 7.7 |
| 9 | 25.7 | 613 | 423 | 7.4 |
| 10 | 15.6 | 640 | 418 | 7.1 |
| 11 | 44.4 | 512 | 389 | 10.2 |
| 12 | 51.0 | 532 | 395 | 11.7 |
| 13 | 22.4 | 588 | 409 | 6.9 |
| 14 | 52.8 | 519 | 384 | 11.0 |
| 15 | 51.0 | 503 | 392 | 10.8 |
| 16 | 19.7 | 625 | 421 | 7.3 |
| 17 | 10.8 | 694 | 441 | 6.1 |
| 18 | 55.2 | 617 | 413 | 10.4 |
| 19 | 38.0 | 693 | 478 | 9.2 |
| 20 | 27.2 | 706 | 473 | 8.2 |
| 21 | 41.6 | 648 | 441 | 9.5 |
| 22 | 36.0 | 783 | 532 | 9.1 |
| 23 | 29.7 | 760 | 509 | 8.4 |
| 24 | 20.6 | 761 | 512 | 7.5 |
| 25 | 30.8 | 728 | 480 | 8.6 |
| 26 | 50.6 | 608 | 403 | 10.1 |
| 27 | 56.6 | 635 | 432 | 10.5 |
| 28 | 32.3 | 713 | 478 | 8.6 |
| 29 | 34.6 | 708 | 460 | 8.8 |
| 30 | 59.1 | 606 | 406 | 10.7 |
| 31 | 45.6 | 681 | 463 | 9.8 |
| 32 | 20.6 | 804 | 523 | 6.5 |

TABLE 8

| Steel | Ferrite percentage (%) | Tensile strength (MPa) | Fatigue strength (MPa) | Critical cracking stroke (mm) |
|---|---|---|---|---|
| *33 | 59.8 | **495 | **380 | 13.1 |
| *34 | 15.7 | 632 | 425 | **5.8 |
| *35 | 45.0 | 566 | 399 | **5.3 |
| *36 | 22.8 | 592 | 412 | **4.9 |
| *37 | 59.3 | 503 | **380 | **5.1 |
| *38 | 47.2 | 534 | 391 | **4.8 |
| *39 | 25.2 | 550 | 401 | **5.4 |
| *40 | 37.3 | 579 | 415 | **5.7 |
| *41 | 18.1 | 643 | 427 | **5.9 |
| *42 | 22.0 | 646 | 427 | **4.7 |

TABLE 8-continued

| Steel | Ferrite percentage (%) | Tensile strength (MPa) | Fatigue strength (MPa) | Critical cracking stroke (mm) |
|---|---|---|---|---|
| *43 | 27.3 | 546 | 405 | **5.8 |
| *44 | 22.8 | 801 | 524 | **5.6 |
| *45 | 50.7 | 677 | 413 | **5.1 |
| *46 | 35.1 | 623 | 417 | **4.8 |
| *47 | 43.2 | 680 | 442 | **5.0 |
| *48 | 68.9 | 618 | 414 | **4.7 |
| *49 | 9.7 | 658 | 434 | **3.2 |
| *50 | 25.3 | 747 | 451 | **5.7 |
| *51 | 48.1 | 646 | 389 | **4.8 |
| *52 | 40.6 | 661 | 443 | **5.3 |
| *53 | 27.4 | 760 | 494 | **5.7 |
| *54 | 44.7 | 639 | 415 | **5.8 |

*:The chemical composition of the steel does not conform to the present invention.
**:The value falls outside the required ranges.

As shown in above-mentioned examples, nitrided steel parts of the present invention have,a high fatigue strength and an excellent bending toughness, or have a high tensile strength, a high fatigue strength, and an excellent bending toughness. Therefore, nitrided steel parts of the present invention are applicable to, for example, crankshafts of automobiles, industrial machinery, and construction machinery. Even when steel products serving as steel stock for nitrided steel parts undergo nitriding without thermal refining so as to become nitrided steel parts, the final nitrided steel parts can reliably have desired characteristics; thus, a large reduction in cost is possible. Accordingly, the present invention provides a significantly large industrial effect.

What is claimed is:

1. A steel for nitriding having the following chemical composition based on % by weight: C: 0.30 to 0.40%, Si: 0.05 to 0.40%, Mn: 0.20 to 0.60%, P: 0.08% or less, S: 0.02 to 0.10%, Cr: 0.10% or less, Ti: 0.005 to 0.013%, Al: 0.005% or less, Ca: 0.0003 to 0.0030%, Pb: 0.20% or less, N: 0.010 to 0.030%, and the balance of Fe and unavoidable impurities.

2. A steel product for nitriding having the following chemical composition based on % by weight: C: over 0.20 to 0.60%, Si: 0.05 to 1.0%, Mn: 0.30 to 1.50%, P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.003 to 0.03%, Al: 0.08% or less, Ca: 0.005% or less, Pb: 0.30% or less, N: 0.008 to 0.020%; value of fn1 expressed by Equation (1) below: not less than 150, and the balance of Fe and unavoidable impurities, which has a ferrite-pearlite microstructure with a ferrite percentage of not less than 10%.

$$fn1=221C(\%)+99.5Mn(\%)+52.5Cr(\%)-304Ti(\%)+577N(\%)+25 \quad (1).$$

3. The steel product for nitriding of claim 2, wherein the value of fn1 is from 150 to 260.

4. The steel product for nitriding of claim 2, wherein the ferrite percentage is from 10 to 70%.

5. The steel product for nitriding of claim 2, wherein the value of fn1 is from 150 to 260, and the ferrite percentage is from 10 to 70%.

6. A steel product for nitriding having the following chemical composition based on % by weight: C: over 0.20 to 0.60%, Si: 0.05 to 1.0%, Mn: 0.30 to 1.50%, P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.003 to 0.03%, Al: 0.08% or less, Ca: 0.005% or less, Pb: 0.30% or less, N: 0.008 to 0.020%; value of fn1 expressed by Equation (1) below: not less than 150, value of fn2 expressed by Equation (2) below: not less than 15, and the balance of Fe and unavoidable impurities, which has a ferrite-pearlite microstructure with a ferrite percentage of not less than 10%.

$$fn1=221C(\%)+99.5Mn(\%)+52.5Cr(\%)-304Ti(\%)+577N(\%)+25 \quad (1),$$

$$fn2=192C(\%)-32.8Mn(\%)-25.1Cr(\%)+467Ti(\%)+726N(\%)+122 \quad (2).$$

7. The steel product for nitriding of claim 6, wherein the value of fn1 is from 150 to 260, and the value of fn2 is from 15 to 70.

8. The steel product for nitriding of claim 6, wherein the ferrite percentage is from 10 to 70%.

9. The steel product for nitriding of claim 6, wherein the value of fn1 is from 150 to 260, the value of fn2 is from 15 to 70, and the ferrite percentage is from 10 to 70%.

10. A nitrided steel part, having a chemical composition of steel comprising, based on % by weight, C: over 0.20 to 0.60%, Si: 0.05 to 1.0%, Mn: 0.20 to 1.50%, P: 0.08% or less, S: 0.005 to 0.10%, Cu: 0.30% or less, Ni: 0.30% or less, Cr: 0.30% or less, Mo: 0.30% or less, V: 0.20% or less, Nb: 0.05% or less, Ti: 0.003 to 0.03%, Al: 0.08% or less, Ca: 0.005% or less, Pb: 0.30% or less, N: 0.008 to 0.030% and the balance of Fe and unavoidable impurities, and a nitrided case.

11. A nitrided steel part, having the chemical composition of the steel as described in claim 1, and a nitrided case.

12. A nitrided steel part, having the chemical composition and microstructure as described in claim 2, and a nitrided case.

13. A nitrided steel part, having the chemical composition and microstructure as described in claim 6, and a nitrided case.

* * * * *